United States Patent [19]

Flachenecker et al.

[11] Patent Number: 4,905,420

[45] Date of Patent: Mar. 6, 1990

[54] GRINDER WITH DUST EXHAUST MEANS

[75] Inventors: Gert Flachenecker, Leonberg; Gustav Schuhmacher, Stuttgart; Fritz Gramm, Stuttgart; Guenther Kloss, Stuttgart, all of Fed. Rep. of Germany

[73] Assignee: C. & E. Fein GmbH & Co., Stuttgart, Fed. Rep. of Germany

[21] Appl. No.: 222,885

[22] Filed: Jul. 22, 1988

[30] Foreign Application Priority Data

Jul. 25, 1987 [DE] Fed. Rep. of Germany ..... 3724747

[51] Int. Cl.[4] ..... B24B 23/04; B24B 55/06

[52] U.S. Cl. ..... 51/170 R; 51/273

[58] Field of Search ..... 51/170 R, 170 MT, 273

[56] References Cited

U.S. PATENT DOCUMENTS 1,412,725 4/1922 Vernon .
1,800,341 4/1931 Davies .
3,619,954 11/1971 Miller .
4,671,019 6/1987 Hutchins ..... 51/170 MT

FOREIGN PATENT DOCUMENTS 2262865 7/1973 Fed. Rep. of Germany .
2513464 10/1975 Fed. Rep. of Germany .
2741325 3/1979 Fed. Rep. of Germany .
3402062 8/1985 Fed. Rep. of Germany ..... 51/170 MT
2365411 4/1978 France .
87/02924 5/1987 World Int. Prop. O. .

*Primary Examiner*—Roscoe V. Parker
*Attorney, Agent, or Firm*—Kramer, Brufsky & Cifelli

[57] ABSTRACT

In order to improve a grinder comprising a grinding tool which is oscillatingly driven through a small pivot angle about a pivot axis fixed on the grinder and which has a grinding surface with at least one corner region, with at least one suction channel extending throughout the grinding tool from an aspirating port to an exhaust port located on a side facing away from the grinding surface, so as to obtain an effective, reliable and, in particular, subsequently attachable dust exhaust system which is designed as simply as possible and does not impair handling of the grinder, it is suggested that the exhaust port be arranged outside of the corner region and that an exhaust hood which can be immovably fixed on the grinder be provided so as to cover the exhaust port in all pivoted positions and allow the corner region of the grinding tool to protrude in an uncovered manner.

55 Claims, 5 Drawing Sheets

Figure 1:
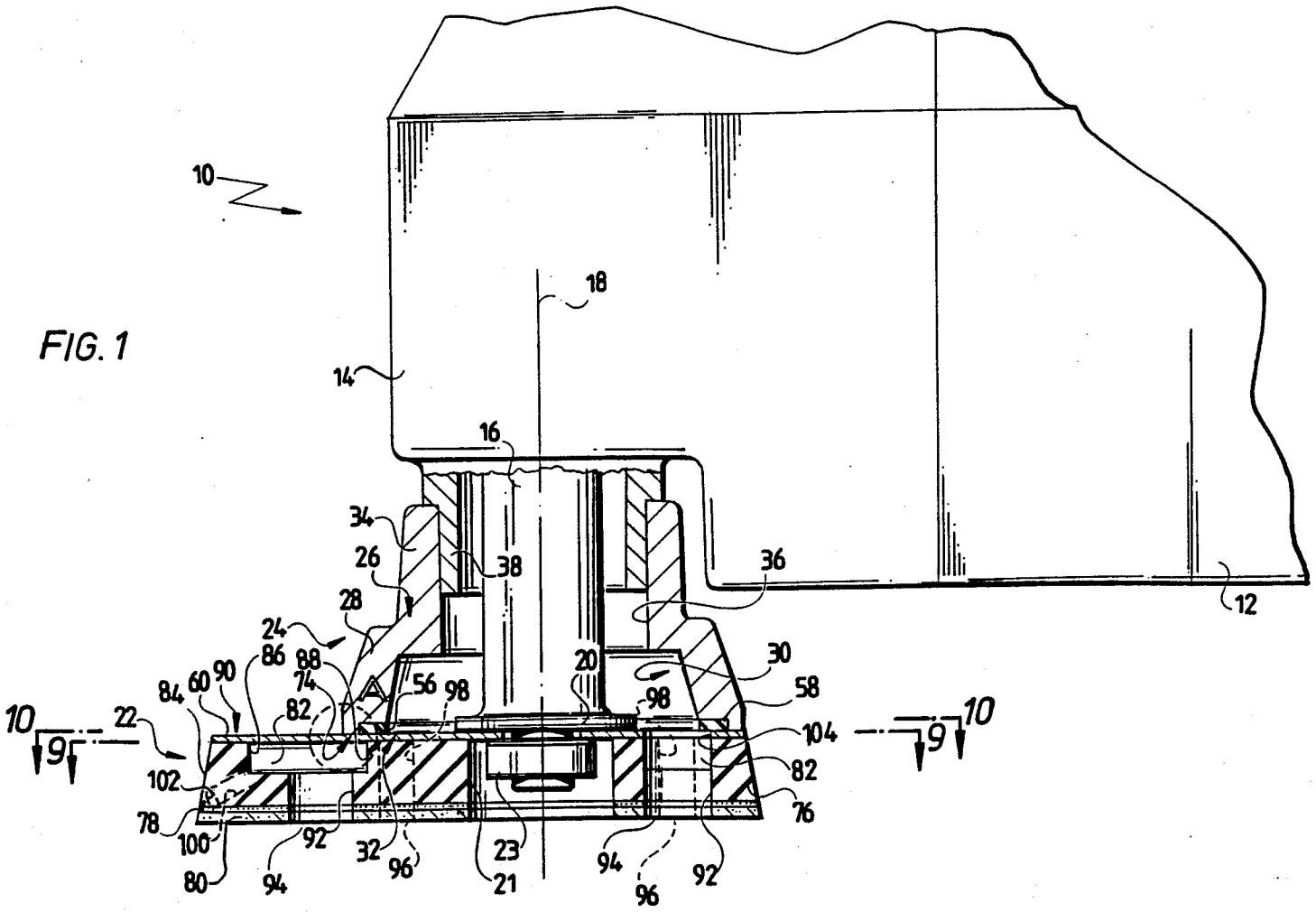

FIG.4
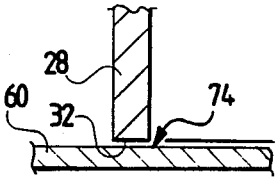
FIG.5
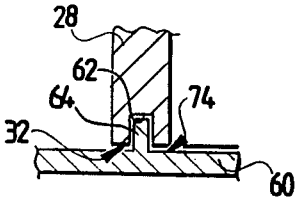
FIG.6
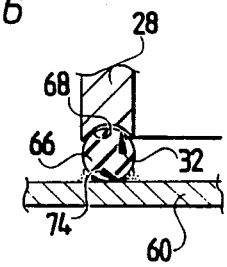
FIG.7
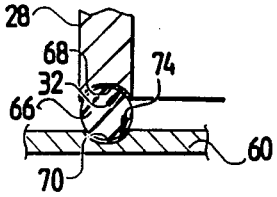
FIG.8
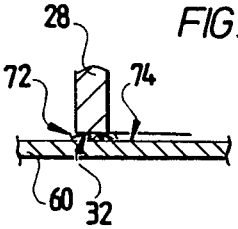
FIG.9
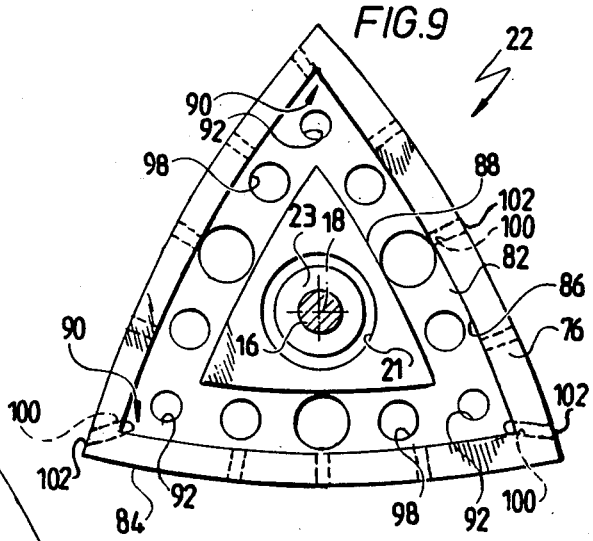
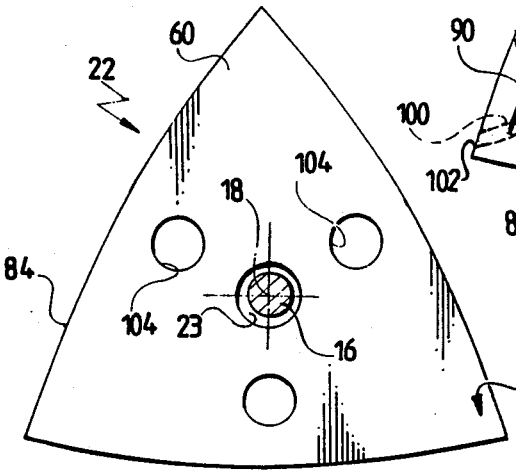
FIG.10

B
10
12
16
22
24
58
110
112
114
116
118
120
122
126
128
130
132
134
136
138
140

GRINDER WITH DUST EXHAUST MEANS

The invention relates to a grinder with a grinding tool which is oscillatingly driven through a small pivot angle about a pivot axis fixed on the grinder. The grinding tool has a grinding surface with at least one corner region and at least one suction channel extends throughout the grinding tool from an aspirating port to an exhaust port located on a side facing away from the grinding surface.

The invention further relates to a grinding tool for grinders with a drive shaft which oscillates about a pivot axis fixed on the grinder. The grinding tool has at least one corner region and at least one suction channel extending throughout it from an aspirating port to an exhaust port located on a side of the grinding tool facing away from the grinding surface. This grinding tool is designed, in particular, for a grinder of the aforesaid kind.

A grinder and a grinding tool of the kind described above are known from PCT Application WO 87/02924. The grinder with dust exhaust means disclosed in this publication comprises a triangular grinding tool in which the exhaust port is arranged in a corner region on the side opposite the grinding surface. An opening extends from this exhaust port in the direction of the grinding surface to channels running above the grinding surface, i.e., for example, above the abrasive paper, to an outer edge of the grinding tool and opening into aspirating ports located at the outer edge. The aspirating ports are located either at the outer edge of this corner region or at the outer edge approximately halfway between two corner regions. In this grinding tool, aspiration of the grinding dust occurs at the outer edge only and the dust then travels through the channels and the opening to the exhaust port located on the side of the grinding tool facing away from the grinding surface in this corner region.

This publication does, however, not disclose how removal of the dust is to be carried out from the exhaust port on. In addition, the arrangement of the aspirating ports at the outer edge, as disclosed in this publication, has the major disadvantage that the aspirating ports are not directly oriented towards the grinding surface. As a result of this, firstly, no direct suction effect can be exerted on the grinding dust and, secondly, a large amount of so-called "infiltrated air" is drawn in, i.e., air which is free from grinding dust. Also, the grinding dust must always be transported to the respective outer edges of the grinding tool to enable removal there, and the grinding dust is, therefore, not drawn off at the actual point at which it is produced.

Accordingly, the object underlying the invention is to improve a grinder of the generic kind so as to obtain an effective, reliable and, in particular, subsequently attachable dust exhaust system which is designed as simply as possible and does not impair handling of the grinder.

This object is achieved, in accordance with the invention, in a grinder of the kind described at the beginning by arranging the exhaust port outside of the corner region and by providing an exhaust hood which can be immovably fixed on the grinder so as to cover the exhaust port in all pivoted positions and allow the corner region of the grinding tool to protrude in an uncovered manner.

The advantage of the inventive design of the grinder is that it provides a simple and reliable solution to the problem of connecting an exhaust means to the exhaust port. Also, the arrangement of the exhaust port in combination with the exhaust hood so as to allow the free corner region to protrude in an uncovered manner underneath the exhaust hood ensures that handling of the grinder as such is not impaired. The structural simplicity is a further characteristic feature of the inventive solution.

The way in which the exhaust hood is to cover the grinding tool outside of the corner region is not specified in the inventive embodiment described above. It is, for example, conceivable for the exhaust hood to engage over an outer rim of the grinding tool so as to eliminate sealing problems at least section-wise between the exhaust hood and the grinding tool. However, this has the disadvantage that the outer rim of the grinding tool cannot be used for grinding edges, which is a major advantage of the grinder according to PCT Application WO 87/02924. For this reason, it is expedient for the exhaust hood to cover the grinding tool within its outer rims in all pivoted positions of the grinding tool.

In a particularly expedient design of the inventive solution, the extent to which the exhaust hood covers the grinding tool in a radial direction extending from its pivot axis to the uncovered protruding corner region is at the most approximately two-thirds of its maximum extent in this direction. It is, in fact, desirable for the amount by which the exhaust hood covers the grinding tool in this direction to be only half of its maximum extent so as to impair handling of the grinding tool to an even lesser degree.

The problem of sealing between the exhaust hood and the grinding tool has not been dealt with in detail in the embodiments described above. In this connection, it has proven useful for the exhaust hood to have a sealing rim which faces the grinding tool and lies in geometrical planes which are invariant with respect to pivotal motion of the grinding tool.

In other words, the sealing rims lie on those geometrical planes whose position is not changed by pivotal motions of the grinding tool. This could, for example, also be a circular, cylindrical surface around the pivot axis. However, to avoid an unnecessarily complicated design of the grinding tool, i.e., a part which is subject to wear, the simplest solution is for the sealing rims to lie in a plane extending perpendicularly to the pivot axis.

Above all, in order to save space, which is of vital importance in the inventive dust exhaust means, it is expedient for the sealing rim to extend so as to enclose the exhaust ports at a minimal distance from these in all pivoted positions.

Within the scope of the inventive solution, it is, however, in many cases, necessary for not only one but several exhaust ports to be arranged on the grinding tool. Therefore, provision is made for the exhaust hood to cover several exhaust ports of the grinding tool jointly and, in this case, it has proven expedient for the sealing rim to enclose the exhaust ports jointly.

As is apparent from the grinder according to PCT Application WO 87/02924, on the one hand, the exhaust hood must be designed so as to save as much space as possible and, on the other hand, the problem of the suction pipe should be solved without detriment to the advantages of the grinder described in this publication. These are, firstly, that the corner region of the grinding tool can be advantageously used for grinding and, secondly, that edge grinding is possible with the outer side rims of the grinding tool. For this reason, provision is made for the exhaust hood to have a ring chamber located above the exhaust ports with an exhaust connection piece opening laterally into the ring chamber at a minimal distance above the sealing rim. Such lateral arrangement of the exhaust connection piece directly above the sealing surfaces results in a construction which saves a great deal of space in the direction of the pivot axis. Above all, any other kind of arrangement of the exhaust connection piece would impair handling of the grinding tool to a much more serious extent.

To obtain a very economical exhaust connection piece design, the exhaust connection piece can be integrally formed on the exhaust hood.

In spite of the advantages of this arrangement of the exhaust connection piece, there is still the problem of how a suction feed pipe is to be optimally led to the exhaust connection piece. In this connection, it is advantageous in a grinder with a housing extending in a radial direction away from the pivot axis for the exhaust connection piece to extend along a bottom face of the housing. Such an exhaust connection piece design enables optimal handling of the inventive grinder without detriment to the possibilities of usage without the dust exhaust means.

In such grinders, the housing itself usually serves as a handle for the grinder. Handling of the grinder can, therefore, be even further improved by the exhaust connection piece resting against the bottom face of the housing with no gap between the exhaust connection piece and the bottom face of the housing. It is, however, even more advantageous for the top wall of the exhaust connection piece facing the housing to be made to match a surface of the bottom face of the housing so as to rest throughout its entire surface against the housing and practically form a unit with it.

In particular, if the housing itself serves as a handle, it is advantageous for the housing to be of approximately cylindrical shape and for the exhaust connection piece to have an approximately inverted trapezoidal cross-section.

A suction hose is normally connected to the exhaust connection piece. It is, therefore, advantageous for the exhaust connection piece to extend beyond a housing end located opposite the pivot axis so the suction hose can be connected to a portion of the exhaust connection piece protruding beyond the housing end. For this purpose, it is expedient for the exhaust connection piece to have a connection for a suction hose in the region extending beyond the housing end.

In the preferred embodiment of the inventive solution described above, it has proven advantageous for the exhaust connection piece to be held on the housing by a bracket in the region of the housing end. This prevents the exhaust connection piece from being turned relative to the housing by pulling forces exerted by the suction hose.

The embodiment of the inventive exhaust hood described above is not necessarily universally usable with different housing types. Therefore, provision is made in a universally usable embodiment of a grinder with a housing extending radially away from the pivot axis for the exhaust connection piece to project in an approximately radial direction from the ring chamber in angular rotational relation to the housing and for the exhaust connection piece to be connected to a bend. This embodiment does, however, have the disadvantage that the exhaust connection piece causes a certain hindrance on the side on which it protrudes.

For this reason, it is advantageous for the exhaust connection piece to project in an approximately radial direction from the ring chamber and to be connected to a bend to which the suction pipe is then, in turn, connectable.

This stationary bend ensures in a simple way that the suction pipe does not intrude upon the working area while the grinder is in operation.

To make the exhaust hood with the exhaust connection piece and the bend suitable for both right-handed and lefthanded operators of the grinder, provision is made for the bend together with the exhaust connection piece to be connectable in at least two different positions in which an opening in the bend points in opposite directions. This enables the exhaust hood to be attached to the grinder such that the exhaust connection piece projects either to the left or to the right side and, in each case, the bend is arranged such that its opening points away from a front side, more particularly, from the front corner region of the grinding tool. The suction pipe can then be connected in a simple manner to this opening in the bend.

The next problem to be dealt with in the space-saving design of the exhaust hood is that of attachment of the exhaust hood to the grinder. In this connection, it has proven expedient for the exhaust hood to have a mounting flange integrally formed on the side of the exhaust hood that faces away from the grinding tool above the ring chamber. This enables simple assembly without any considerable increase in the overall height.

The design of the mounting flange as a cylindrical extension with a clamping element is preferred not only because of its structural simplicity but also because it allows rotation of the exhaust hood relative to the grinding tool after the clamping element has been slackened. Therefore, in accordance with usage, the exhaust connection piece can be rotated relative to the grinding tool which, for example, enables changeover of the position of the exhaust connection piece from that which is favorable for right-handed operators to that which is favorable for left-handed operators.

Since the clamping element also has a certain space requirement, but arrangement of the clamping element in the construction described so far should not additionally impair handling of the grinder, it is expedient for the clamping element to be arranged in the region of the exhaust connection piece such that rotation of the exhaust connection piece causes the clamping element which may likewise constitute a hindrance to be simultaneously moved away along with the exhaust connection piece.

Sealing between the sealing rims of the exhaust hood and the grinding tool is usually necessary to avoid too great a loss of suction power between the sealing rims and the grinding tool. There is also the danger of whistling noises occurring if there is only a sealing gap between the sealing rims and the grinding tool. Accordingly, in an advantageous embodiment, the sealing rim is designed to accommodate a sealing ring made of a sealing material with sliding capability. This sealing ring is merely to be placed in the accommodating means and should consist of a material which is capable of sliding easily on both the sealing rims of the exhaust hood and the sealing surfaces of the grinding tool located opposite the sealing rims.

A bend 48 having an opening 50 is placed on the exhaust connection piece 40 so as to engage over an opening 46 of the exhaust connection piece 40. The opening 50 of the bend 48 lies in a plane which is approximately perpendicular to a plane laid through the opening 46 of the exhaust connection piece 40.

Figure 2:
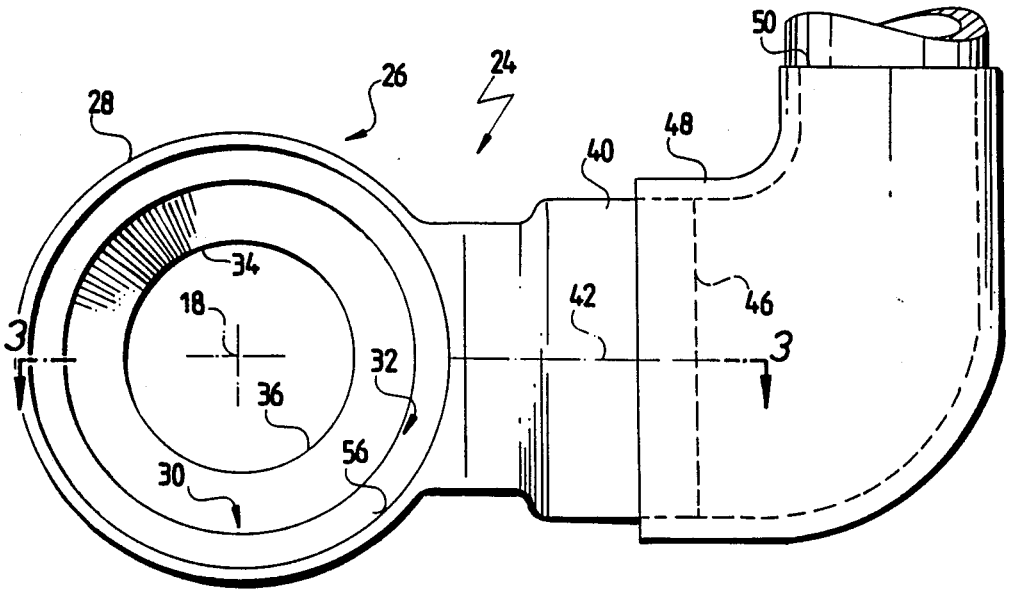
Figure 3:
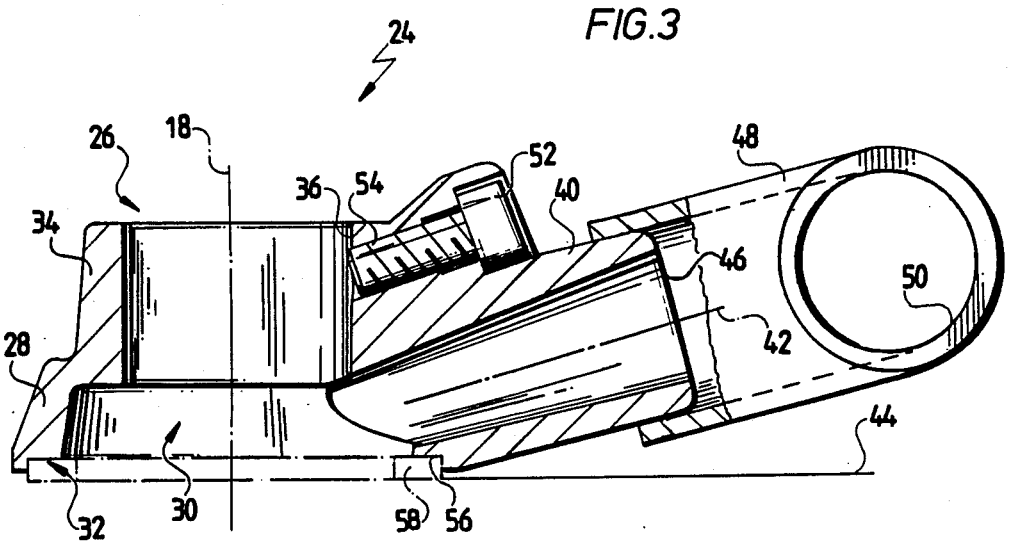

The exhaust connection piece 40 is expediently shaped in such a manner as to allow the bend 48 to be placed on the exhaust connection piece 40 in either of two positions after rotation through 180 degrees. Hence the opening 50 of the bend 48 illustrated in FIG. 2 can point either in an upward or in a downward direction.

The cylindrical extension 34 of the exhaust hood 24, which forms a snug fit with the cylindrical portion 38, is additionally fixed in position by a positioning screw 52 which is preferably accommodated above the exhaust connection piece 40 on its side opposite the plane 44. The threaded section 54 of the positioning screw 52 penetrates the cylindrical extension 34 and thereby allows it to be clamped to the cylindrical portion 38.

In order that the dust may be exhausted from the ring chamber 30 with optimal efficiency and over as large a cross-section as possible, the exhaust connection piece 40 is arranged in such a manner as to open into the cylindrical wall 28 directly above the sealing rims 32 with a cross-section corresponding approximately to the height of the ring chamber 30 above the sealing rim 32.

In accordance with the invention, the plane 44 in which the sealing rim 32 lies is arranged perpendicular to the pivot axis 18 such that it can be termed invariant with respect to the pivot axis 18 as the position of plane 44 relative to the pivot axis 18 and to the gearing 14 of the grinder 10 is not affected by pivotal motion of the pivot shaft 16 and the grinding tool 22 about the pivot axis 18.

A groove 56 which is open towards the grinding tool 22 and the ring chamber 30 is expediently machined into the sealing rim 32. The purpose of this groove is to accommodate a freely insertable sealing ring 58. The sealing ring 58 is preferably made of a sealing material with capability to slide freely, i.e., a material which, on the one hand, possesses a certain elasticity and, on the other hand, is capable of sliding without difficulty over other materials with a smooth surface. In particular, the sealing ring 58 is conceived of as being made of felt.

This sealing ring 58 ensures a more or less air-tight connection between the sealing rim 32 and a cover plate 60 of the grinding tool 22 lying parallel to the plane 44. This cover plate 60 is preferably made of sheet metal.

Sealing of the gap between the sealing rim 32 of the exhaust hood 24 and the cover plate 60 of the grinding tool 22 can, however, also be achieved in a different way. For example, in the embodiment shown in FIG. 4, only a narrow air gap is present between the sealing rim 32 of the cylindrical wall 28 and a sealing surface 74 located on the cover plate 60 opposite the sealing rim. Such a sealing is possible because the cover plate 60 is clamped to the connecting flange 20 of the pivot shaft 16 for rotation with the pivot shaft 16 and hence is oriented parallel to the plane 44. In another variant of the embodiment shown in FIG. 4, which is illustrated in FIG. 5, a labyrinth seal is provided between the cover plate 60 and the sealing rim 32. For this purpose, a U-shaped groove 62 which is open towards the grinding tool 22 is machined in the sealing rim 32 and a projection 64 fixed on the cover plate 60 extends into the groove 62. This projection 64 can be made of various materials. It could, for example, be made of an elastic material which preferably slides smoothly in the groove 62.

In further embodiments of the sealing between the cover plate 60 and the sealing rim 32 as shown in FIGS. 6 and 7, an 0-ring 66 is positioned between the, cover plate 60 and the sealing rim 32, in which case, the sealing rim 32 is preferably provided with a recess 68 to hold the O-ring. This O-ring 66 may be releasably accommodated between the cover plate 60 and the sealing rim 32, but it may also be glued to the cover plate 60 or, as illustrated in FIG. 7, it may be held in a further recess 70 in the cover plate 60.

FIG. 8 illustrates a simple and very practicable solution. Here the cover plate 60 is provided with a layer of an easily sliding sealing material 72 which is preferably of fibrous texture. This layer 72 is easily applied to the cover plate 60 during manufacture of the grinding tool and it may either cover the cover plate 60 completely or—as illustrated in FIG. 8—it may be applied within a sealing surface 74 only on the cover plate 60 opposite the sealing rim 32.

In addition to the cover plate 60 clamped to the connecting flange 20 for rotation with the pivot shaft 16, the grinding tool 22, as shown in FIG. 1, has an elastic layer 76 underneath the cover plate 60 which is preferably made of cellular rubber and is fixed to the cover plate 60. Underneath this elastic layer 76 there is a layer of hook-and-loop fastening material 78 to which the abrasive paper 80 forming a grinding surface is attached.

A ring channel 82 is machined into this elastic layer 76, preferably on the side facing the cover plate 60. For reasons of simplicity and expediency, this channel 82 is of approximately rectangular cross-section and extends along and at a distance from an outer rim 84 of the grinding tool 22. In the case of a uniform cross-section, outer delimiting surfaces 86 and inner delimiting surfaces 88 of this ring channel 82 extend parallel to the outer rim periphery 84 and hence into the corner regions 90 of the triangular grinding tool illustrated in FIG. 9.

Owing to the fact that the greatest amount of grinding dust is produced in the corner regions 90 during a grinding operation, an opening 92 must be provided in each of the corner regions 90 so as to extend from the ring channel 82 through the elastic layer 76 to the hook-and-loop fastening material 78 and then through the hook-and-loop fastening material 78 and the abrasive paper 80 to an aspirating port 94 from which the developing grinding dust can be drawn off by suction into the ring channel 82.

Additional openings 98 communicating with further aspirating ports 96 may be provided along the rest of the ring channel 82 between the respective corner regions 90.

The aspirating ports 94 and the openings 92 should preferably have smaller cross-sections than the aspirating ports 96 and the openings 98 in order that the suction is more effective in the corner regions 90 than between these.

It is also possible to provide channels 100 which extend at an incline from the ring channel 82 in the direction of the hook-and-loop fastening material towards the outer rim 84 and open into aspirating ports 102 located at the outer rim 84 above the layer of hook-and-loop fastening material.

The connection between the ring chamber 30 in the exhaust hood 24 and the ring channel 82 in the elastic layer 76 is effected via exhaust ports 104 provided in the cover plate 60. These ports 104 are represented in the plan view of the cover plate 60 in FIG. 10. In the embodiment shown in FIG. 10, these exhaust ports 104 are bores which are located in the elastic layer 76 exactly above the ring channel 82 and whose diameter is approximately equal to the width of the ring channel 82. These exhaust ports 104 in the cover plate 60 are preferably not arranged facing the respective corner regions 90 but instead are located in an angular rotational position relative to these with respect to the pivot axis 18. In the embodiment shown in FIG. 10, this rotational angle is 60 degrees and the exhaust ports 104 are, therefore, each located between the corner regions.

This position of the exhaust ports 104 allows them to be spaced at the shortest possible distance from the pivot axis 18 and, in addition, to be directly connected with the ring chamber 82.

Figure 11:
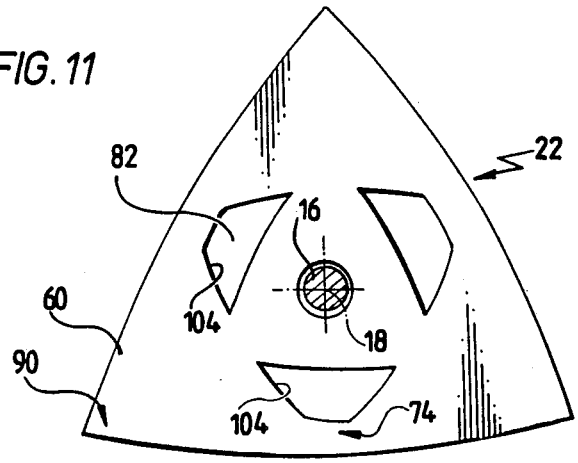

In a variant of the embodiment shown in FIG. 10, the exhaust port 104 may be replaced either by three bores located side by side at the same point or in accordance with the embodiment illustrated in FIG. 11 by an opening across the entire width of the ring channel 82 which, in accordance with the invention, extends in its expanse in the longitudinal direction of the ring channel 82 as far as but no further than the annular sealing surface 74 which, in turn, is located opposite the circular sealing rim 32.

Figure 12:
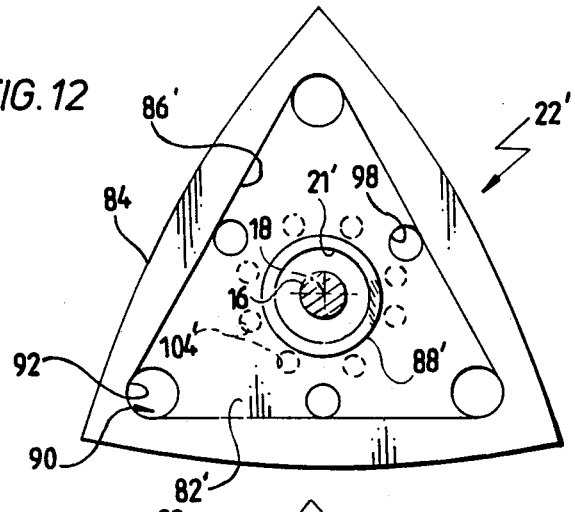

A further possible configuration of the ring channel 82' is shown in a further embodiment illustrated in FIG. 12, as a variant of the embodiment shown in FIG. 9. Here, as in FIG. 9, the ring channel 82' does not communicate with the central recess 21'. In conformance with the triangular shape of the grinding tool 22', the ring channel 82' is also triangular in shape. In accordance with the invention, the outer delimiting lines 86' serving as connecting lines between the corners may, however, be straight or even curved in the direction towards the central recess 21' in order to ensure greater stability. In addition, the exhaust ports 104' indicated by broken lines are arranged in a position close to the inner delimiting surfaces 88' which, in this case, are of circular, cylindrical configuration.

Figure 13:
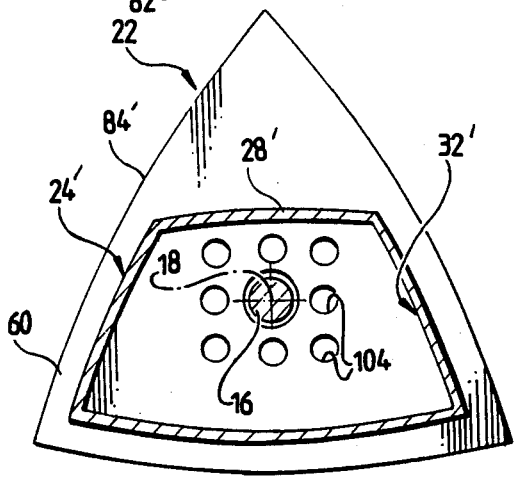

As shown in the plan view in FIG. 13, the exhaust hood 24 need not necessarily have a circular sealing rim 32 which would necessarily result in annular sealing surfaces 74 on the cover plate 60. It is also possible for the exhaust hood 24' to have a sealing rim 32' of approximately trapezoidal cross-section, as illustrated in FIG. 13. In this case, the pivot axis 18 penetrates the cross-section of the suction hood 24' eccentrically such that a front wall 28' extends to only half the total extent of the cover plate in the direction of the front corner region 90' at the most. In this embodiment of the inventive solution, care must be taken to ensure that the sealing rim 32' of the exhaust hood 24' lies within the outer rim 84' of the grinding tool 22' in all pivoted positions of the grinding tool 22'.

Figures 14, 15:
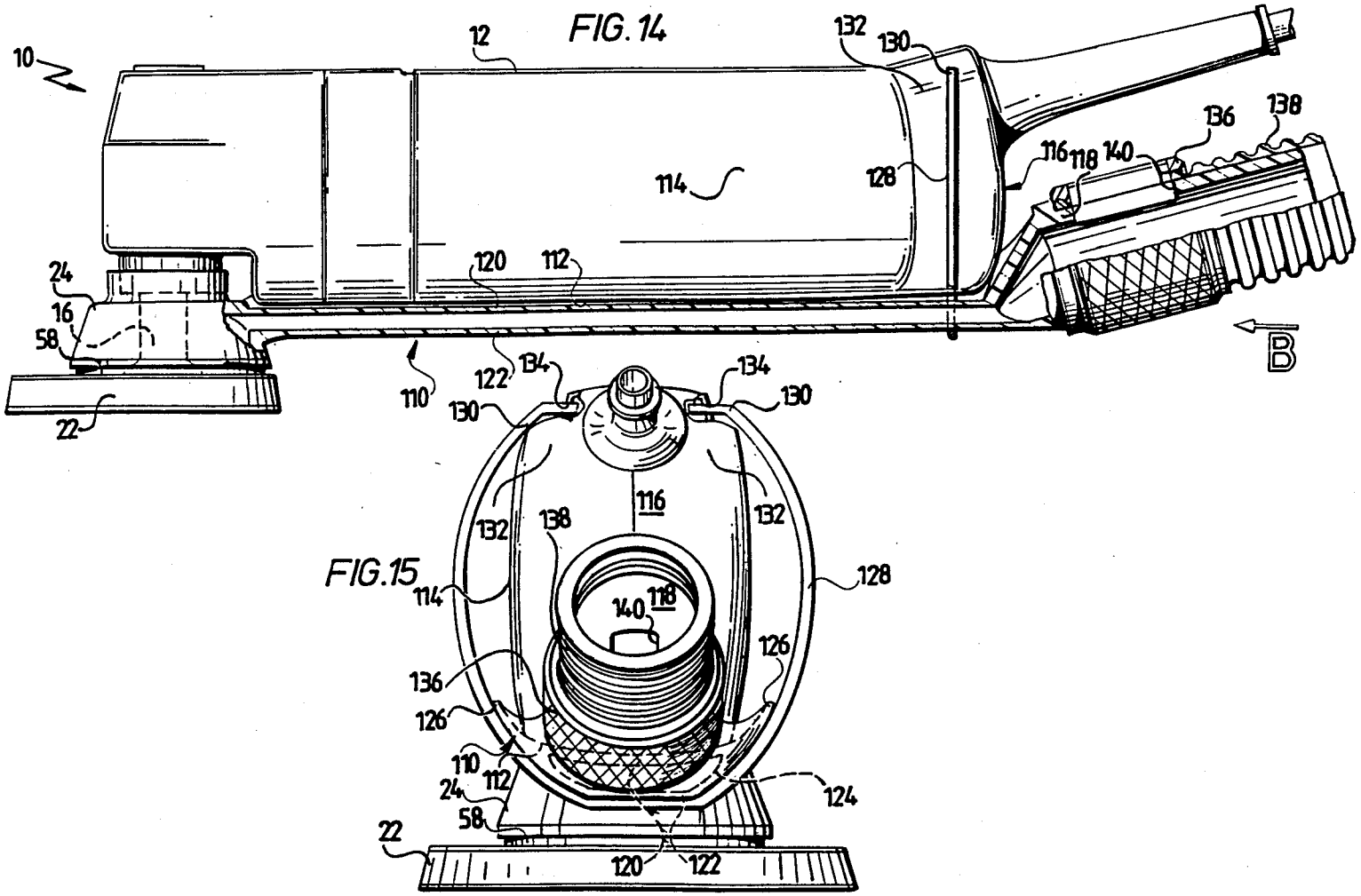

A tenth embodiment, illustrated in FIG. 14, is identical with the previous ones in terms of the arrangement and design of the pivot shaft 16 and the grinding tool 22 and also the exhaust hood 24 except for the design and arrangement of the exhaust connection piece 40. Identical parts are, therefore, designated by identical reference numerals and are not described separately.

In contrast with the embodiment according to FIG. 1, an exhaust connection piece 110 extending along a bottom face 112 of a housing 114 beyond a housing end 116 and carrying a connection piece 18 for a hose in a region protruding beyond the housing end 116 is formed on the exhaust hood 24.

As illustrated in FIG. 15, the housing 114 is essentially cylindrical in shape and has an approximately polygonal cross-section with bulgings.

The exhaust connection piece 110 comprises a top wall 120, a bottom wall 122 extending approximately parallel to it and two side walls 124 which are of inverted trapezoidal configuration, with the top wall 120 forming the longest side of this trapezoid and the two side walls 124 forming the two lateral legs of the trapezoid. In addition, the top wall 120 which rests on a surface of the bottom face 112 is made to fit this surface in terms of both its cross-section and its longitudinal section such that the entire exhaust connection piece 110 lies throughout the full extent of its top wall 120 against the housing 114 along almost the full length of the housing 114 as far as the housing end 116. The exhaust connection piece 110 also has lateral extensions 126 formed thereon to prolong the side walls 124. These extensions 126 likewise rest throughout their full extent against the bottom face 112 and additionally improve the positive attachment of the exhaust connection piece 110 to the bottom face 112 of the housing 114.

As in the embodiment represented in FIG. 1, the exhaust hood 24 is held on the cylindrical portion 38. The exhaust connection piece 110 is additionally held in position by a U-shaped bracket 128 whose free ends 130 are bent towards each other and each engage a bore 134 arranged on opposite sides on a top face 132 of the housing 114. This bracket 128 embraces the entire bottom face 112 of the housing 114 including the exhaust connection piece 110 near the housing end 116.

In that region of the exhaust connection piece 110 which protrudes beyond the housing end 116, the exhaust connection piece 110 enlarges into the hose connection piece 118. This connection piece for a hose is preferably of circular cross-section and is bent upwards in the direction of the top face 132 of the housing 114. The hose connection piece 118 is additionally provided with a sleeve 136 for air regulation which is rotatably adjustable on an adjustment thread, thereby covering a bypass opening 140 to various degrees. Hence adjustment of the air-regulation sleeve 136 enables regulation of the suction power available in the grinding tool 22.

The present disclosure relates to the subject matter disclosed in German Application No. P 37 24 747.6 of July 25, 1987, the entire specification of which is incorporated herein by reference.

What is claimed is:

1. A grinder comprising:

drive means, including a pivot shaft having a pivot axis, for oscillatingly driving the pivot shaft; and a grinding tool oscillatingly driven through a small pivot angle about the pivot axis, said grinding tool having a grinding surface with at least one corner region;

an aspirating port disposed on said grinding tool;

an exhaust port located on a portion of said grinding tool facing away from said grinding surface and outside of said corner region;

at least one suction channel extending throughout said grinding tool from the aspirating port to the exhaust port; and an exhaust hood removably fixed on said grinder, covering said exhaust port in all pivoted positions of the grinding tool as driven, and allowing said corner region of said grinding tool to protrude from said exhaust hood in an uncovered manner.

2. A grinder as defined in claim 1, wherein:
said grinding tool has an outer periphery; and
said exhaust hood covers said grinding tool in all pivoted positions within the outer periphery of said grinding tool.

3. A grinder as defined in claim 1, wherein:
said exhaust hood covers said grinding tool in a radial direction extending from said pivot axis to said uncovered protruding corner region by approximately up to two-thirds of the maximum extent of said grinding tool in this direction.

4. A grinder as defined in claim 3, wherein:
said exhaust hood covers said grinding tool in a radial direction extending from said pivot axis to said uncovered protruding corner region by approximately half of the maximum extent of said grinding tool in this direction.

5. A grinder as defined in claim 1, wherein:
said exhaust hood has a sealing rim facing said grinding tool and lying in geometrical planes which are invariant with respect to pivotal motion of said grinding tool.

6. A grinder as defined in claim 5, wherein:
said sealing rim extends so as to enclose said exhaust ports at a minimal distance from these in all pivoted positions.

7. A grinder as defined in claim 1, wherein:
said grinding tool is provided with several exhaust ports; and
said exhaust hood covers said several exhaust ports of said grinding tool jointly.

8. A grinder as defined in claim 7, wherein:
said sealing rim encloses said several exhaust ports jointly.

9. A grinder as defined in claim 5, wherein:
said exhaust hood has a ring chamber located above said exhaust port; and
an exhaust connection piece opening laterally into said ring chamber at a minimal distance above said sealing rim.

10. A grinder as defined in claim 9, wherein:
said exhaust connection piece is integrally formed on said exhaust hood.

11. A grinder as defined in claim 9, further comprising:
a housing extending in a radial direction away from said pivot axis; and
wherein said exhaust connection piece extends along a bottom face of said housing.

12. A grinder as defined in claim 11, wherein:
said exhaust connection piece rests against said bottom face of said housing.

13. A grinder as defined in claim 12, wherein:
said exhaust connection piece has a top wall facing said housing and matching a surface of said housing.

14. A grinder as defined in claim 13, wherein:
said housing is of approximately cylindrical shape; and
said exhaust connection piece has an approximately inverted trapezoidal cross-section.

15. A grinder as defined in claim 11, wherein:
said housing has an end located opposite said pivot axis; and
said exhaust connection piece extends beyond the housing end located opposite said pivot axis.

16. A grinder as defined in claim 15, wherein:
said exhaust connection piece has a hose connection piece in a region extending beyond said housing end.

17. A grinder as defined in claim 11, wherein:
said exhaust connection piece is held on said housing by a bracket in the region of said housing end.

18. A grinder as defined in claim 9 further comprising:
a housing extending in a radial direction away from said pivot axis and;
wherein said exhaust connection piece projects in an approximately radial direction from said ring chamber in angular rotated relation to said housing and is connected to a bend.

19. A grinder as defined in claim 18, wherein:
said bend is connectable to said exhaust connection piece in at least two different positions in which an opening in the bend points in opposite directions.

20. A grinder as defined in claim 9, wherein:
said exhaust hood carries a mounting flange integrally formed on its side facing away from said grinding tool above said ring chamber.

21. A grinder as defined in claim 20, wherein:
said mounting flange is a cylindrical extension with a clamping element.

22. A grinder as defined in claim 21, wherein:
said clamping element is arranged in the region of said exhaust connection piece.

23. A grinder as defined in claim 5, wherein:
said sealing rim has means for accommodating a sealing ring made of a sealing material having sliding capability.

24. A grinder as defined in claim 23, wherein:
said sealing rim is coated with sealing material having sliding capability.

25. A grinder as defined in claim 23, wherein:
said sealing material having sliding capability is elastic.

26. A grinder as defined in claim 23, wherein:
said sealing material having sliding capability is felt.

27. A grinder as defined in claim 5, wherein:
a sealing element made of rubber or polyurethane foam is inserted between said sealing rim and said grinding tool.

28. A grinder as defined in claim 2, wherein:
said exhaust hood covers said grinding tool in a radial direction extending from said pivot axis to said uncovered protruding corner region by approximately two-thirds of the maximum extent of said grinding tool in this direction at the most.

29. A grinder as defined in claim 10, further comprising:
a housing extending in a radial direction away from said pivot axis, wherein:
said exhaust connection piece extends along a bottom face of said housing.

30. A grinder as defined in claim 24, wherein:
said sealing material with sliding capability is elastic.

31. A grinding tool for grinders having a drive shaft which oscillates about a pivot axis fixed on said grinder, said grinding tool comprising:
a tool element having a grinding surface and at least one corner region;

an aspirating port disposed on said tool element;

an exhaust port located on a portion of said tool element facing away from said grinding surface and outside of said corner region; and at least one suction channel extending throughout said tool element from the aspirating port to the exhaust port;

wherein said aspirating port is arranged in said grinding surface of at least one corner region; and wherein said exhaust port is arranged outside of the at least one corner region at a minimal radial distance from said pivot axis and extends in a radial direction in relation to said pivot axis over up to half of the maximum radial extend of said grinding element.

32. A grinding tool as defined in claim 31, wherein:

said exhaust port is arranged in a surface of said grinding tool extending perpendicularly to said pivot axis and located opposite said grinding surface.

33. A grinding tool as defined in claim 31, wherein:

said exhaust port is arranged in a position displaced through an angle of rotation relative to said corner region with said pivot axis being the axis of rotation.

34. A grinding tool as defined in claim 31, wherein:

said exhaust port is surrounded by a sealing surface lying in a geometrical plane which is invariant with respect to pivotal motion of said grinding tool.

35. A grinding tool as defined in claim 34, wherein:

said sealing surface has accommodating means for a seal made of a sealing material with sliding capability.

36. A grinding tool as defined in claim 34, wherein:

said sealing surface is provided with sealing material with sliding capability.

37. A grinding tool as defined in claim 36, wherein:

said sealing material with sliding capability is applied to said sealing surface as a coating.

38. A grinding tool as defined in claim 32, wherein:

said exhaust port is arranged at a minimal radial distance from said pivot axis.

39. A grinding tool as defined in claim 42, wherein:

said ring channel extends around a central recess for a clamping element without being connected to it.

40. A grinding tool as defined in claim 31, wherein:

several exhaust ports are provided.

41. A grinding tool as defined in claim 40, wherein:

said suction channel is a ring channel extending in said grinding tool and connecting said exhaust ports.

42. A grinding tool for grinders having a drive shaft which oscillates about a pivot axis fixed on said grinder, said grinding tool comprising:

a tool element having a grinding surface and at least one corner region;

an aspirating port disposed on said tool element;

a plurality of exhaust ports located on a portion of said tool element facing away from said grinding surface and outside of said corner region; and at least one suction channel extending throughout said tool element from the aspirating port to the exhaust ports;

wherein said aspirating port is arranged in said grinding surface of at least one corner region;

wherein said exhaust port is arranged outside of the at least one corner region;

wherein said suction channel is a ring channel extending in the tool element and connecting said exhaust ports;

wherein the configuration of said ring channel is made to match an external contour of said grinding tool element; and wherein said ring channel extends at a distance from the outer periphery of the grinding tool element.

43. A grinding tool as defined in claim 42, characterized in that said exhaust ports are surrounded by a common sealing surface.

44. A grinding tool as defined in claim 42, wherein:

said ring channel extends around a central recess for a clamping element without being connected to it.

45. A grinding tool as defined in claim 42, wherein:

said ring channel is of substantially U-shaped cross-section and extends directly below a cover plate of said grinding tool in an elastic layer of said grinding tool.

46. A grinding tool as defined in claim 42, wherein:

further aspirating ports are provided in said grinding surface at a distance from and along said outer rim of said grinding surface.

47. A grinding tool as defined in claim 42, wherein:

said aspirating ports, viewed in the direction of said pivot axis, are arranged so as to be covered throughout their entire extent by said ring channel.

48. A grinding tool as defined in claim 42, wherein:

said exhaust ports viewed in the direction of said pivot axis, are arranged so as to be covered throughout their entire extent by said ring channel.

49. A grinding tool as defined in claim 42, wherein:

said exhaust ports are arranged in the regions of said ring channel located closest to said pivot axis.

50. A grinding tool for grinders having a drive shaft which oscillates about a pivot axis fixed on said grinder, said grinding tool comprising:

a tool element having a grinding surface and at least one corner region;

at least one aspirating port disposed on said tool element;

at least one exhaust port located on a portion of said tool element facing away from said grinding surface and outside of said corner region; and at least one suction channel extending throughout said tool element from said at least one aspirating port to said at least one exhaust port;

wherein said at least one aspirating port is arranged in said grinding surface of at least one corner region;

wherein said at least one exhaust port is arranged outside of the at least one corner region;

wherein the grinding element is of two-cornered or three-cornered configuration and has a diadic or triadic axis symmetry with respect to its shape and the arrangement of said aspirating ports and said exhaust ports.

51. A grinding tool for grinders having a drive shaft which oscillates about a pivot axis fixed on said grinder, said grinding tool comprising:

a tool element having a grinding surface and at least one corner region;

at least one aspirating port disposed on said tool element;

an exhaust port located on a portion of said tool element facing away from said grinding surface and outside of said corner region; and at least one suction channel, in the form of a ring channel, extending throughout said tool element from said at least one aspirating port to said exhaust port;

wherein said aspirating port is arranged in said grinding surface of at least one corner region; and wherein said exhaust port is arranged outside of the at least one corner region;

further comprising:

second aspirating ports disposed at the outer periphery of said tool element; and channels extending from said ring channel in the direction of the outer periphery of the tool element and communicating with said second aspirating ports.

52. A grinding tool for grinders with a drive shaft which oscillates about a pivot axis fixed on said grinder and with exhaust port connection means, said grinding tool having:

means for fixedly connecting it to said drive shaft;

a grinding surface;

a surface opposite said grinding surface and extending perpendicularly to said pivot axis;

at least one corner region;

at least one aspirating port arranged in said grinding surface and in said corner region;

at least one exhaust port located in said surface opposite said grinding surface and outside said corner region, said exhaust port being freely movable with respect to said exhaust port connection means; and at least one suction channel extending from said aspirating port to said exhaust port.

53. A grinding tool for grinders with a drive shaft which oscillates about a pivot axis fixed on said grinder and with exhaust port connection means, said grinding tool having:

means for fixedly connecting it to said drive shaft;

a grinding surface;

a side of said grinding tool facing away from said grinding surface;

at least one corner region;

at least one aspirating port arranged in said grinding surface and in said corner region;

at least one exhaust port located on said side facing away from said grinding surface and outside said corner region and arranged in a position displaced through an angle of rotation relative to said corner region with said pivot axis being the axis of rotation, said exhaust port being freely movable with respect to said exhaust port connection means; and at least one suction channel extending from said aspirating port to said exhaust port.

54. A grinding tool for grinders with a drive shaft which oscillates about a pivot axis fixed on said grinder, said grinding tool having:

means for fixedly connecting it to said drive shaft;

a grinding surface;

a side of said grinding tool facing away from said grinding surface;

at least one corner region;

at least one aspirating port arranged in said grinding surface and in said corner region;

at least one exhaust port located on said side facing away from said grinding surface and outside said corner region;

a sealing surface surrounding said exhaust port and lying in a geometrical plane which is invariant with respect to pivotal motion of said grinding tool; and at least one suction channel extending from said aspirating port to said exhaust port.

55. A grinding tool as defined in claim 54, characterized in that said sealing surface surrounds said pivot axis.

* * * * *

UNITED STATES PATENT AND TRADEMARK OFFICE

CERTIFICATE OF CORRECTION

PATENT NO. : 4,905,420

DATED : March 6, 1990

INVENTOR(S) : G. Flachenecker, G. Schuhmacher, F. Framm

It is certified that error appears in the above-identified patent and that said Letters Patent is hereby corrected as shown below:

In Claim 31, (Column 15), line 14, "extend" should read --extent--.

Signed and Sealed this

Twelfth Day of November, 1991

*Attest:*

*Attesting Officer*

HARRY F. MANBECK, JR.

*Commissioner of Patents and Trademarks*